US006641917B2

(12) United States Patent
Itsukaichi et al.

(10) Patent No.: US 6,641,917 B2
(45) Date of Patent: Nov. 4, 2003

(54) SPRAY POWDER AND METHOD FOR ITS PRODUCTION

(75) Inventors: Tsuyoshi Itsukaichi, Nishikasugai-gun (JP); Satoru Osawa, Nishikasugai-gun (JP)

(73) Assignee: Fujimi Incorporated, Nishikasugai-gun (JP)

( * ) Notice: Subject to any disclaimer, the term of this patent is extended or adjusted under 35 U.S.C. 154(b) by 0 days.

(21) Appl. No.: 10/052,457

(22) Filed: Jan. 23, 2002

(65) Prior Publication Data

US 2002/0136894 A1 Sep. 26, 2002

(30) Foreign Application Priority Data

Jan. 25, 2001 (JP) ..... 2001-016585

(51) Int. Cl.[7] ..... B32B 5/16

(52) U.S. Cl. ..... 428/402; 428/404; 428/569; 428/667; 427/421; 427/446; 427/450; 419/28; 419/35; 148/513; 75/252

(58) Field of Search ..... 428/569, 402, 428/404, 667; 75/252; 419/28, 35; 148/513; 427/446, 450, 421

(56) References Cited

U.S. PATENT DOCUMENTS

| | | | | |
|---|---|---|---|---|
| 4,865,152 A | | 9/1989 | Gardner, Jr. | 180/305 |
| 4,925,626 A | | 5/1990 | Anand et al. | 419/18 |
| 5,075,129 A | | 12/1991 | Jackson et al. | 427/451 |
| 5,419,976 A | | 5/1995 | Dulin | 428/570 |
| 5,580,833 A | | 12/1996 | Fu et al. | 501/87 |
| 5,747,163 A | | 5/1998 | Douglas | 428/404 |
| 5,763,106 A | | 6/1998 | Blanchard et al. | 428/570 |
| 5,789,077 A | | 8/1998 | Nakahama et al. | 428/336 |
| 5,928,976 A | | 7/1999 | Yamamoto et al. | 501/87 |
| 6,004,372 A | | 12/1999 | Quets | 75/255 |
| 6,254,704 B1 | | 7/2001 | Laul et al. | 148/513 |
| 6,482,534 B2 | * | 11/2002 | Itsukaichi et al. | 428/569 |

FOREIGN PATENT DOCUMENTS

| | | |
|---|---|---|
| EP | 0 657 237 | 6/1995 |
| GB | 874 463 | 8/1961 |

* cited by examiner

*Primary Examiner*—Leszek Kiliman
(74) *Attorney, Agent, or Firm*—Oblon, Spivak, McClelland, Maier & Neustadt, P.C.

(57) ABSTRACT

A spray powder to be used for forming a coating, which comprises from 80 to 97 wt %, based on the total weight, of a cermet powder and from 3 to 20 wt %, based on the total weight, of a metal powder, wherein the metal powder comprises Cr and Ni in a total amount of at least 90 wt %, based on the total weight of the metal powder, and the content of Cr is from 0 to 55 wt %, based on the total weight of the metal powder.

11 Claims, 1 Drawing Sheet

SPRAY POWDER AND METHOD FOR ITS PRODUCTION

BACKGROUND OF THE INVENTION

1. Field of the Invention

Figure 1:
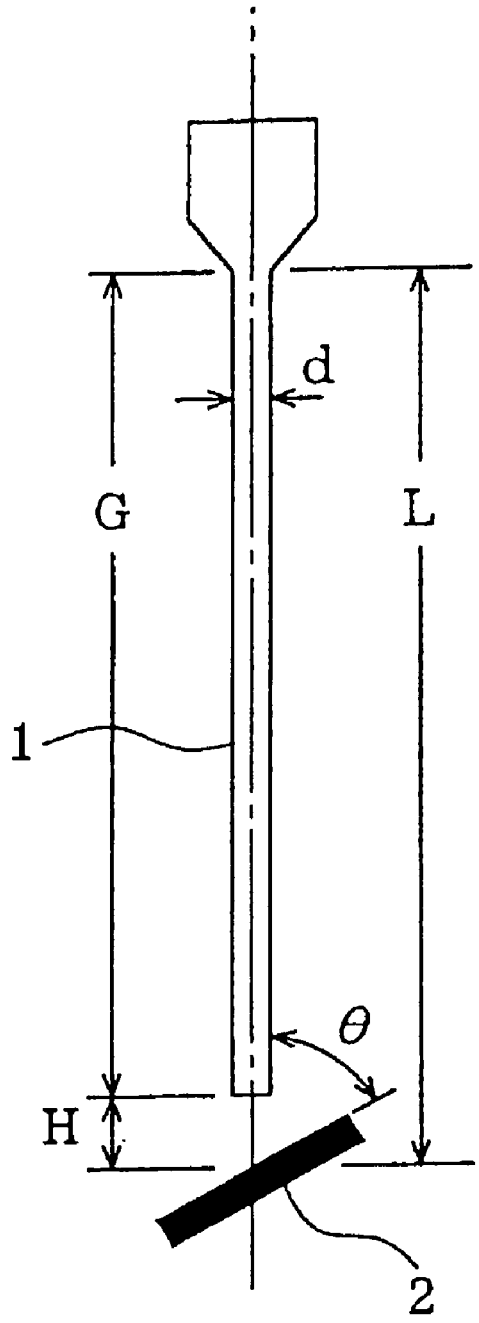

The present invention relates to a spray powder to be used for forming a sprayed coating on the surface of a component part and a method for producing such a spray powder. More particularly, the present invention relates to a spray powder to be used for surface modification of a metal part represented by e.g. a machine part of an excavator to be used for civil engineering works, i.e. for surface modification of a substrate which is required to have extremely high impact resistance, excellent wear resistance and excellent corrosion resistance and wear resistance even under a wet environment, and a method for producing such a spray powder.

2. Description of the Background

Metal parts of various industrial machines or general-purpose machines are required to have various properties such as impact resistance, corrosion resistance and wear resistance depending upon the respective purposes. However, in many cases, the metal materials (substrates) constituting such metal parts can not adequately satisfy the required properties by themselves, and it is often attempted to solve such problems by surface modification by forming a coating on the substrate surface.

A thermal spraying process is one of surface modification techniques which are practically used, as well as physical vapor deposition or chemical vapor deposition. The thermal spraying process has characteristics such that the size of a substrate to be treated is not limited, a uniform coating can be formed on a substrate having a large surface area, the speed of forming the coating is high, its applications on site is easy, and a thick coating can be formed relatively easily. Accordingly, in recent years, its application has been expanded to various industries, and it has become an extremely important surface modification technique.

In the same meaning as "thermal spraying", a term such as "building up" or "spraying" may sometimes be used. Among these terms, there is no distinct difference in the definitions, and there is no particular distinction also among the powders used therefor. A powder for forming a sprayed coating may not necessarily be limited for thermal spraying. Namely, a powder for thermal spraying may be used for building up or spraying, and inversely, a powder for building up or spraying may be used for thermal spraying.

Accordingly, "spray powder" in the present invention may be one which is used for "building up" or "spraying".

Tungsten carbide is a material which has extremely high hardness and is excellent in wear resistance, and it is used as mixed or complexed with a metal such as Ni, Cr or Co, or an alloy containing such a metal, as a binder, to form a ceramic/metal composite material, i.e. a cermet, which is widely used as a material for a spray powder. "Cermet" is a term coined by taking the first three letters of each of "Ceramics" and "Metal". Specifically, it is one having hard ceramic particles bound by a metal matrix and is a composite material having high hardness and high toughness. In the field of tool materials, cermet means a material of TiC type or Ti(C,N) type, but in a broad sense, it includes composite materials comprising ceramics and metals, in general.

A cermet powder is usually prepared by a technique represented by e.g. an agglomeration-sintering method, a sintering-crushing method or a fusion-crushing method.

The method for preparation of a cermet powder by the agglomeration-sintering method is as follows.

Firstly, a dispersion of a binder (such as PVA: polyvinyl alcohol) in a solvent (water or a solvent such as an alcohol), is added to a fine powder of the starting material, followed by mixing to prepare a slurry. This slurry is formed into a spherical agglomerated powder by means of e.g. a spray drier. Then, this agglomerated powder is subjected to de-waxing and sintering to remove the organic binder from the agglomerated powder and for the purpose of imparting a proper mechanical strength to the agglomerated powder particles.

And, the powder after the sintering is crushed by means of a crusher such as a ball mill. By this crushing, individual agglomerated powder particles will be separated, whereby a spherical powder can be obtained. Then, classification is carried out for the purpose of obtaining a spray powder having a particle size distribution required depending upon the spraying conditions or the type of the spraying apparatus to be used. For the classification, not only a method by means of a sieve, but also classification by a gas stream and other method, as well as a combination thereof, are known.

The powder particles obtainable by this agglomeration-sintering method are spherical and have a relatively uniform particle size distribution, whereby they have good flowability, and they are porous, have a large specific surface area and are easily meltable, and thus they have a characteristic that the spraying efficiency is high. Thus, this method is suitable as a method for preparing the cermet powder.

Whereas, the method for preparing the cermet powder by the sintering-crushing method is as follows.

Firstly, a fine powder of the starting material is sintered, and the obtained sintered product is mechanically crushed and then classified to obtain a spray powder having a desired particle size distribution. Industrially, after mixing the starting material, a method such as press molding may be carried out for the purpose of obtaining a sintered product having higher denseness. Further, the technique and purpose of the classification are the same as in the above-mentioned agglomeration-sintering method. The powder obtainable by this sintering-crushing method is composed of dense and firm particles, which have angular or bulky shapes having edges specific to a crushed powder.

On the other hand, the method for preparing a cermet powder by the fusion-crushing method is as follows.

Firstly, the starting material is heated, melted and cooled, and then, the obtained solidified product (ingot) is mechanically crushed and classified. The melting is carried out for the purpose of obtaining a dense powder, and an arc furnace is used for an industrial purpose. Further, the crushing of the ingot may be carried out by a technique such as a drop hammer or hammering, whereby coarse crushing, intermediate crushing or fine crushing may be carried out. The method and purpose of the crushing are the same as in the above agglomeration-sintering method or the sintering-crushing method.

The powder obtainable by this fusion-crushing method is homogeneous and composed of particles which are more dense and firm than the powder obtainable by the sintering-crushing method. Further, the shape of particles is angular or bulky similar to the particle shape obtainable by the sintering-crushing method.

The cermet powder prepared by such an agglomeration-sintering method, a sintering-crushing method or a fusion-crushing method, may be used as it is, as a spray powder. However, for the purpose of forming a dense sprayed coating, a self-melting alloy powder may be added and mixed to the cermet powder to obtain a spray powder, which may be sprayed, followed by fusing treatment to form a coating.

On the other hand, as a spray powder for forming a sprayed coating having excellent corrosion resistance and wear resistance under a wet environment, a WC/CrC/Ni type spray powder prepared by mixing Ni or a Ni-base alloy as a binder to tungsten carbide or chromium carbide as a ceramic material, followed by an agglomeration-sintering method, is widely used in the industrial field.

However, with a sprayed coating formed by using this WC/CrC/Ni type spray powder, it has been pointed out that toughness and impact resistance are not so high. Specifically, this spray powder has been used as sprayed to a substrate which is susceptible to wearing especially in a wet environment, but has had a problem that upon receipt of a large impact, the sprayed coating tends to have cracking, or the coating tends to peel from the substrate. The useful life of the substrate will be extremely short once the sprayed coating has cracking or the coating is peeled, and the range of application of such a coating formed by such a spray powder is limited. Accordingly, a sprayed coating having excellent toughness and impact resistance has been desired.

In order to solve the above problems, the present inventors have proposed in (1) Japanese Patent Application JP-A-2000-38969, a spray powder which is capable of forming a sprayed coating having high toughness and impact resistance as compared with a conventional WC/CrC/Ni type cermet spray powder and also having excellent corrosion resistance and wear resistance in a wet environment, by employing a starting material powder having the particle size distribution properly adjusted.

With the sprayed coating formed by using the above spray powder, the impact resistance is superior to the sprayed coating formed by using a currently commercially available WC/CrC/Ni type cermet spray powder, but there has been a problem that no substantial superiority is observed as compared with a sprayed coating formed by using a WC/Co type cermet spray powder as the most common spray cermet powder.

In general, a cermet sprayed coating has a characteristic that the impact resistance is low although it has high hardness and is excellent in wear resistance. Accordingly, a sprayed coating having excellent impact resistance has been desired without lowering the corrosion resistance and wear resistance.

SUMMARY OF THE INVENTION

The present invention has been made to solve this problem, and it is an object of the present invention to provide a spray powder which is capable of forming a sprayed coating having extremely high impact resistance, excellent wear resistance as well as excellent corrosion resistance and wear resistance even in a wet environment, and a method for its production.

In order to solve the above problem, the present invention provides a spray powder to be used for forming a coating, which comprises from 80 to 97 wt %, based on the total weight, of a cermet powder and from 3 to 20 wt %, based on the total weight, of a metal powder, wherein the metal powder comprises Cr and Ni in a total amount of at least 90 wt %, based on the total weight of the metal powder, and the content of Cr is from 0 to 55 wt %, based on the total weight of the metal powder.

DETAILED DESCRIPTION OF THE DEFERRED EMBODIMENTS

The present invention provides such a spray powder, wherein the cermet powder contains tungsten carbide, chromium carbide and Ni; wherein the cermet powder contains tungsten carbide, Co and Cr; or wherein the mean particle size of tungsten carbide constituting the cermet powder is from 2 to 20 $\mu$m.

Further, the present invention provides such a spray powder, wherein the mean particle size of chromium carbide constituting the cermet powder is from 1 to 10 $\mu$m; or wherein the content of C in the metal powder is at most 0.4 wt %, based on the total weight of the metal powder.

Still further, the present invention provides a method for producing a spray powder to be used for forming a coating, which comprises adding and mixing a cermet powder prepared by an agglomeration-sintering method, a sintering-crushing method or a fusion-crushing method, and a metal powder comprising Cr and Ni in a total amount of at least 90 wt %, based on the total weight of the metal powder, and the content of Cr being from 0 to 55 wt %, based on the total weight of the metal powder, so that their contents would be from 80 to 97 wt % and from 3 to 20 wt %, respectively, based on the total weight of the spray powder.

In the accompanying drawing, FIG. 1 is a view illustrating a falling ball impact tester used for a peel resistance test of a sprayed coating.

In FIG. 1, reference numeral 1 represents a guide pipe, numeral 2 a test piece, symbol L a steel ball falling distance (1,000 mm), symbol H a distance between the discharge outlet and the falling point of the steel ball (20 mm), d an inner diameter of the guide pipe ($\phi$ 29.3 mm), symbol G the length of the guide pipe (980 mm), and $\theta$ a collision angle (60°).

Now, the spray powder and the process for its production according to the present invention, will be described in detail.

In the spray powder of the present invention, the cermet powder is preferably a cermet powder which contains tungsten carbide, chromium carbide and Ni, or tungsten carbide, Co and Cr.

Further, in the cermet powder, a Ni alloy may be used instead of Ni or together with Ni. Likewise, a Co alloy may be employed instead of Co or together with Co. Likewise, a Cr alloy may be employed instead of Cr or together with Cr.

In the cermet powder containing tungsten carbide, chromium carbide and Ni, tungsten carbide serves to improve the wear resistance, and Ni serves not only as a binder but also to improve toughness and corrosion resistance. And, chromium carbide serves to further improve corrosion resistance of tungsten carbide and Ni. With a view to improving corrosion resistance and wear resistance in a wet environment, the contents of tungsten carbide, chromium carbide and Ni, based on the total weight of the cermet powder, are usually from 60 to 85 wt %, from 10 to 30 wt % and from 4 to 15 wt %, respectively, preferably from 65 to 80 wt %, from 15 to 25 wt % and from 5 to 12 wt %, respectively.

On the other hand, in the cermet powder containing tungsten carbide, Co and Cr, the cermet powder comprising tungsten carbide and Co is a spray powder which is commonly known to have excellent toughness, wear resistance and impact resistance. And, Cr serves to improve the corrosion resistance of the cermet comprising tungsten carbide and Co. As the cermet powder contains Cr, it has corrosion resistance comparable to the above-mentioned cermet containing tungsten carbide, chromium carbide and Ni and shows a substantial superiority to other cermets. With a view to improving impact resistance as well as the corrosion resistance and wear resistance in a wet environment, the contents of tungsten carbide, Co and Cr, based on the total weight of the cermet powder, are usually from 80 to 92 wt %, from 4 to 20 wt % and 2 to 15 wt %, preferably from 84 to 90 wt %, from 6 to 12 wt % and from 2 to 10 wt %, respectively.

In the spray powder of the present invention, tungsten carbide constituting the cermet powder includes WC and $W_2C$. However, it is preferred to employ WC. When $W_2C$ is used, if it is exposed to a high temperature during e.g. a sintering step or spraying, it may undergo decarburization to form W, whereby the characteristics of the sprayed coating are likely to deteriorate. When WC is used, such decarburization scarcely takes place. If such a reaction takes place, it is possible to suppress formation of W or a change of the characteristics of the sprayed coating.

Likewise, chromium carbide includes $Cr_3C_2$, $Cr_7C_3$, and $Cr_{23}C_6$. Chromium carbide is said to undergo a crystal phase change from $Cr_3C_2$ to $Cr_7C_3$, from $Cr_7C_3$ to $Cr_{23}C_6$, and $Cr_{23}C_6$ to Cr, by decarburization. It is necessary to suppress a substantial change of the properties of the sprayed coating. Accordingly, it is preferred to use $Cr_3C_2$ or $Cr_7C_3$, more preferably $Cr_3C_2$.

In the spray powder of the present invention, tungsten carbide and chromium carbide constituting the cermet powder, have a tendency that if their mean particle sizes are too small, cracking is likely to take place, and the impact resistance tends to be low, when the sprayed coating receives a substantial external force (impact). On the contrary, if the mean particle sizes of tungsten carbide and chromium carbide are too large, it tends to be difficult to obtain spherical agglomerated powder particles or agglomerated powder particles having the starting material components uniformly dispersed, in the agglomeration step, or if thermal spraying is carried out by using a spray powder prepared by using such agglomerated powder particles, the spraying efficiency tends to be very low. Accordingly, the mean particle size of tungsten carbide is usually from 2 to 20 $\mu$m, preferably from 5 to 12 $\mu$m, and the mean particle size of chromium carbide is usually from 1 to 10 $\mu$m, preferably from 3 to 7 $\mu$m.

Further, if tungsten carbide and chromium carbide to be used for the cermet powder of the present invention contain free carbon, the bond strength in the interior of the sprayed coating tends to decrease, and the impact resistance tends to remarkably decrease. Accordingly, the contents of free carbon in tungsten carbide and chromium carbide to be used for the cermet powder, are preferably at most 0.05 wt % and at most 0.1 wt %, respectively.

On the other hand, in the spray powder of the present invention, the metal powder of e.g. Ni, Co or Cr constituting the cermet powder is preferably one uniformly pulverized. If the mean particle size of the metal powder to be used in the agglomeration step, is small, it is possible to prepare a cermet powder which is more spherical and has higher mechanical strength, a powder having a desired particle size distribution can be prepared more readily, and the yield of the product will be high. Accordingly, the mean particle size of such a metal powder is usually at most 5 $\mu$m, preferably at most 3 $\mu$m. The mean particle size of an alloy powder prepared by an atomizing method, is usually at most 10 $\mu$m, preferably at most 5 $\mu$m.

Further, as such a metal powder to be mixed with the cermet powder, it is preferred to use one which is adjusted to have the same particle size distribution as the cermet powder obtained by the above-mentioned agglomeration-sintering method, the sintering-crushing method or a fusion-crushing method. As such a metal powder, a metal powder having high sphericity, prepared by an atomizing method, is typical. The atomizing method includes a water atomizing method and a gas atomizing method, and depending upon the type of the method used, the amount of dissolved oxygen in the metal powder and the shape of the powder are slightly different, but the influence to the properties of the sprayed coating is small. Accordingly, any metal powder may be employed so long as it is a metal powder obtained by an atomizing method.

The higher the content of Cr contained in the metal powder to be mixed with the cermet powder of the present invention, the higher the improvement in the corrosion resistance and wear resistance of the sprayed coating, but the lower the impact resistance. Inversely, the smaller the content, the larger the improvement in the impact resistance of the sprayed coating, but the lower the corrosion resistance and wear resistance tend to be. For example, if the content of Cr in the metal powder becomes at least 55 wt %, based on the entire weight of the metal powder, the impact resistance of the sprayed coating decreases substantially, and the coating is likely to have cracks. Accordingly, the content of Cr in the metal powder in the present invention is usually from 0 to 55 wt %, preferably from 5 to 30 wt %, based on the total weight of the metal powder.

Further, C in the metal powder may be included as an impurity in the step of preparing the metal powder to be mixed with the cermet powder of the present invention, or it may be added for the purpose of pulverization at the time of atomizing or for other purposes. Further, the base metal of the metal powder may sometimes contain C. However, if the content of C is too much relative to the total weight of the metal powder, the impact resistance of the coating tends to decrease remarkably. Accordingly, the content of C in the metal powder is usually at most 0.4 wt %, preferably at most 0.2 wt %, based on the total weight of the metal powder.

Further, to the metal powder to be mixed with the cermet powder of the present invention, in addition to Ni, Cr, components represented by e.g. Si, B, Al, Mn, Ti, Fe, S and Mo, may be included as impurities or may be added for the purpose of pulverization at the time of atomizing or for other purposes. Such components may also be contained in the base metal of the metal powder. If these components are too much relative to the total weight of the metal powder, the impact resistance of the sprayed coating is likely to decrease substantially. Accordingly, the total content of Si, B, Al, Mn, Ti, Fe, S and Mo in the above metal powder is usually at most 10 wt %, preferably at most 3 wt %, based on the total weight of the metal powder.

The spray powder of the present invention is produced by using the above-mentioned respective components by the following method.

Firstly, starting material powders are mixed so that from 60 to 80 wt % of tungsten carbide, from 10 to 30 wt % of chromium carbide and from 5 to 15 wt % of Ni, or from 80 to 92 wt % of tungsten carbide, from 4 to 20 wt % of Co and from 2 to 15 wt % of Cr, are contained, based on the 5 total weight of the cermet powder, and a WC/CrC/Ni type cermet or a WC/Co/Cr type cermet is prepared by a common agglomeration-sintering method, a sintering-crushing method or a fusion-crushing method.

In the agglomeration-sintering method among the methods for preparation of the cermet powder, it is preferred to carry out agglomeration so that agglomerated powder particles have a particle size distribution of from 5 to 75 $\mu$m, followed by sintering at a temperature of at least 900° C. for at least 5 hours. The sintering conditions are required to be optimized depending upon the composition and the desired properties of the spray powder, but uniform hard spherical particles can be obtained by sintering for at least 5 hours at a constant temperature. Further, when a metal powder of e.g. Ni, Co, Cr or an alloy thereof, or a carbide ceramics such as chromium carbide and/or tungsten carbide, is used as a cermet material, it is necessary to ensure that such material will not be oxidized during de-waxing or sintering, and it is usually treated in vacuum or in an inert gas atmosphere.

As an example, an agglomerated powder having a particle size distribution of from 5 to 75 μm may be sintered, crushed and classified to obtain a cermet having a particle size distribution of from 6 to 63 μm which is suitable for high velocity flame spraying. Further, by changing agglomeration, crushing or classification conditions, as the case requires, it is possible to prepare a cermet powder having a particle size distribution of from 6 to 38 μm, from 10 to 45 μm, from 15 to 45 μm, from 15 to 53 μm or from 20 to 63 μm, and such a powder may be selected for use depending upon the type of the spraying apparatus or the spraying conditions.

In the present invention, "the particle size distribution" means that with respect to the lower limit of the particle size distribution, the proportion of particles smaller than the particle size represented by the value obtained by using a laser diffraction type particle size measuring apparatus LA-300 (manufactured by HORIBA, Ltd.) is at most 5%, and with respect to the upper limit of the particle size distribution, the proportion of particles larger than the particle size represented by the value obtained by using a low tap method (JIS R6002) is at most 5%. For example, when the particle size distribution is from 15 to 45 μm, the proportion of particles of at most 15 μm obtained by using the laser diffraction type particle size measuring apparatus is at most 5%, and the proportion of particles of at least 45 μm obtained by using a low tap method is at most 5%. On the other hand, "the mean particle size" represents a value of D50 obtained by using the same LA-300.

The spray powder of the present invention is produced by mixing the cermet prepared by the above-described method with the metal powder prepared separately.

The metal powder contains from 0 to 55 wt % of Cr, based on the total weight of the metal powder, and Ni is added so that the total with Cr will be a content of at least 90 wt %, to obtain a metal powder.

And, the above cermet powder and the metal powder are uniformly mixed so that the content of the metal powder will usually be from 3 to 20 wt %, preferably from 7 to 16 wt %, based on the total weight of the spray powder, to obtain a spray powder of the present invention.

If the content of the cermet in the spray powder exceeds 97 wt %, and the content of the metal powder is less than 3 wt %, the proportion occupied by the metal phase dotted in the sprayed coating tends to decrease, whereby the impact resistance of the coating will be low. Inversely, if the content of the cermet is less than 80 wt %, and the content of the metal powder exceeds 20 wt %, the proportion occupied by the ceramic component excellent in corrosion resistance and wear resistance, decreases, whereby the corrosion resistance and wear resistance of the sprayed coating will be low.

The reason why the sprayed coating formed by the spray powder of the present invention, has extremely high impact resistance, excellent wear resistance and excellent corrosion resistance and wear resistance in a wet environment, is considered to be as follows.

From the inspection of the structure of the coating formed by thermal spraying by means of the spray powder of the present invention, it is confirmed that the metal powder component is deposited in a state having a proper thickness and is dotted as relatively large metal phases. When a large external force is exerted to the sprayed coating, such metal phases play the role of a buffer and absorb and disperse the external force, whereby the impact resistance of the sprayed coating will be substantially improved.

On the other hand, from the inspection of the structure of a coating formed by thermal spraying by using a conventional spray powder, it is observed that the materials constituting the spray powder are fused and mixed with other materials, or only a thin metal phase is observed, and relatively large metal phases deposited in a state having a proper thickness, as observed with the spray powder of the present invention, are not observed. Accordingly, if a large external force is exerted to the sprayed coating, as no metal phase is present which plays the role of a buffer sufficiently, the external force can not be adequately absorbed and dispersed, and the coating fracture will result, and thus it is considered that the impact resistance of the sprayed coating tends to be low.

Further, from the inspection of the structure of a coating formed by thermal spraying by using a spray powder prepared by complexing all components i.e. the cermet powder and the metal powder in the spray powder of the present invention, from the beginning, followed by an agglomeration-sintering method, a sintering-crushing method or a fusion-crushing method, without adopting a method of separately preparing the cermet powder and the metal powder and mixing them in a proper ratio as in the method for producing a spray powder of the present invention, it is observed that the metal powder component is mixed with other materials in the coating, or only a thin metal phase is observed, and it is considered impossible to obtain high impact resistance as in the case where the spray powder of the present invention is used.

The spray powder of the present invention is applicable to a known thermal spraying method such as high velocity flame spraying represented by an apparatus such as JP-5000 manufactured by TAFA Company, SB-HVOF manufactured by UNIQUE COAT TECHNOLOGIES or a Diamond Jet manufactured by Sulzer Metco, flame spraying represented by an apparatus such as 6P manufactured by Sulzer Metco, or plasma spraying represented by an apparatus such as 9MB manufactured by Sulzer Metco or SG-100 manufactured by PRAXAIR.

The flame spraying is a thermal spraying method in which a spray powder is sent into a flame formed by combustion of a fuel (such as acetylene) with oxygen, and the powder is impinged to the substrate in a molten or semi-molten state for deposition to form a coating. The high velocity flame spraying is a kind of flame spraying, but is a thermal spraying method wherein the pressure of the combustion chamber is increased, and the velocity of the combustion flame is made to be very high, whereby sprayed particles are highly accelerated to generate a strong impinging power, and a dense and highly adhesive coating can be formed. The plasma spraying is a thermal spraying method wherein the spray powder is heated by a high temperature plasma, and the spray powder is melted and sprayed to a substrate to form a coating.

The sprayed coating obtained by using the spray powder of the present invention is preferably such that the metal powder component is deposited in a proper thickness and is dotted as relatively large metal phases in the coating. To form such a coating, it is necessary not to heat the spray powder, particularly the metal powder component, too much and to highly accelerate to deposit coating by a large impinging force to the substrate. As compared with flame spraying or plasma spraying, high velocity flame spraying can highly accelerate the sprayed particles and has a short retention time in the combustion flame, whereby the spray powder is not exposed to a high temperature so much, and it is suitable for the spray powder of the present invention. Among high velocity flame spraying methods, JP-5000 or SB-HVOF is particularly preferred, since it is thereby possible to highly accelerate the spray powder, and whereby the spray powder is not exposed to a high temperature.

Now, the present invention will be described in further detail with reference to Examples. However, it should be understood that the present invention is by no means restricted to such specific Examples.

Preparation of Spray Powder

Firstly, in accordance with the composition as identified in Table 1,the starting materials for a cermet powder were mixed, and a 3.6% PVA aqueous solution was mixed thereto, followed by thorough stirring to obtain a slurry. This slurry was formed into a spherical agglomerated powder having a particle size distribution of from 5 to 75 $\mu$m by means of e.g. a spray agglomerator, and the powder was de-waxed in an argon atmosphere in a vacuum de-waxing sintering furnace and then sintered at 1,250° C. for 5 hours. After the sintering, the powder was crushed by means of a ball mill and then classified by means of a vibration sieving machine and an air flow classifier to obtain a cermet powder having a particle size distribution of from 15 to 45 $\mu$m.

Further, separately from the above cermet, in accordance with the composition as identified in Table 1, a metal powder prepared by an atomizing method is classified in the same manner as the cermet powder to adjust the particle size to from 15 to 45 $\mu$m.

The cermet and the metal powder thus obtained were mixed by a V-type mixing apparatus to obtain test samples of Examples 1 to 15 (Table 1) and Comparative Examples 1 to 8 (Table 2).

The contents of Comparative Examples 1 to 8 are as follows. Namely, Comparative Example 1 is a WC/CrC/Ni spray powder by an agglomeration-sintering method, which is commercially available for corrosion resistance and wear resistance; Comparative Example 2 is a WC/Co spray powder by an agglomeration-sintering method, which is commercially available for wear resistance; Comparative Example 3 is a WC/Co/Cr spray powder by an agglomeration-sintering method, which is commercially available for corrosion resistance and wear resistance; Comparative Example 4 is a spray powder prepared by an agglomeration-sintering method by mixing all components i.e. the cermet powder and the metal powder in the spray powder from the beginning; Comparative Example 5 is one wherein the amount of the metal powder added, was outside the scope of the present invention; Comparative Example 6 is one wherein the amount of the metal powder was likewise outside the scope of the present invention; Comparative Example 7 is one wherein the Cr content in the metal powder was outside the scope of the present invention; and Comparative Example 8 is one wherein the Ni and Cr contents in the metal powder were outside the scope of the present invention.

TABLE 1

| | Cermet powder | | | | | | | | |
|---|---|---|---|---|---|---|---|---|---|
| | | WC | CrC | Metal material 1 | | Metal material 2 | | WC powder mean | CrC powder mean |
| | wt % *1) | wt % *2) | wt % *3) | Chemical component | wt % *2) | Chemical component | wt % *2) | particle size ($\mu$m) | particle size ($\mu$m) |
| Ex. 1 | 90 | 70 | 20 | Ni | 10 | — | — | 10 | 5 |
| Ex. 2 | 95 | 70 | 20 | Ni | 10 | — | — | 10 | 5 |
| Ex. 3 | 82 | 70 | 20 | Ni | 10 | — | — | 10 | 5 |
| Ex. 4 | 90 | 70 | 20 | Ni | 10 | — | — | 10 | 5 |
| Ex. 5 | 90 | 70 | 20 | Ni | 10 | — | — | 10 | 5 |
| Ex. 6 | 90 | 70 | 20 | Ni | 10 | — | — | 10 | 5 |
| Ex. 7 | 90 | 70 | 20 | Ni | 10 | — | — | 10 | 5 |
| Ex. 8 | 90 | 70 | 15 | Ni-50Cr | 15 | — | — | 10 | 5 |
| Ex. 9 | 90 | 86 | — | Co-30Cr | 14 | — | — | 10 | — |
| Ex. 10 | 90 | 70 | 20 | Ni | 10 | — | — | 3 | 2 |
| Ex. 11 | 90 | 70 | 20 | Ni | 10 | — | — | 15 | 8 |
| Ex. 12 | 90 | 70 | 20 | Ni | 10 | — | — | 10 | 5 |
| Ex. 13 | 90 | 70 | 20 | Ni | 10 | — | — | 10 | 5 |
| Ex. 14 | 90 | 70 | 20 | Ni | 10 | — | — | 1.5 | 0.8 |
| Ex. 15 | 90 | 70 | 20 | Ni | 10 | — | — | 25 | 12 |

| | Metal powder | | | | |
|---|---|---|---|---|---|
| | wt % *1) | Chemical component *4) | Ni + Cr wt % *3) | Cr wt % *3) | C wt % *3) |
| Ex. 1 | 10 | Ni-19.6Cr-1.17Si-0.10Fe-0.01S-0.01C | 98.7 | 19.6 | 0.01 |
| Ex. 2 | 5 | Ni-19.6Cr-1.17Si-0.10Fe-0.01S-0.01C | 98.7 | 19.6 | 0.01 |
| Ex. 3 | 18 | Ni-19.6Cr-1.17Si-0.10Fe-0.01S-0.01C | 98.7 | 19.6 | 0.01 |
| Ex. 4 | 10 | Ni-0.01C | 100.0 | 0 | 0.01 |
| Ex. 5 | 10 | Ni-39.7Cr-1.22Si-0.11Fe-0.01S-0.01C | 98.7 | 39.7 | 0.01 |
| Ex. 6 | 10 | Cr-47.4Ni-1.67Si-0.75Mn-0.36Fe-0.09C | 97.1 | 49.8 | 0.09 |

TABLE 1-continued

| | | | | | |
|---|---|---|---|---|---|
| Ex. 7 | 10 | Ni-4.44Al-0.19Si-0.01C | 95.3 | 0 | 0.10 |
| Ex. 8 | 10 | Ni-19.6Cr-1.17Si-0.10Fe-0.01S-0.01C | 98.7 | 19.6 | 0.01 |
| Ex. 9 | 10 | Ni-19.6Cr-1.17Si-0.10Fe-0.01S-0.01C | 98.7 | 19.6 | 0.01 |
| Ex. 10 | 10 | Ni-19.6Cr-1.17Si-0.10Fe-0.01S-0.01C | 98.7 | 19.6 | 0.01 |
| Ex. 11 | 10 | Ni-19.6Cr-1.17Si-0.10Fe-0.01S-0.01C | 98.7 | 19.6 | 0.01 |
| Ex. 12 | 10 | Ni-19.7Cr-1.12Si-0.10Fe-0.32C | 98.5 | 19.7 | 0.32 |
| Ex. 13 | 10 | Ni-20.0Cr-0.44C-0.43Si-0.21Mn-0.13Fe | 98.8 | 20.0 | 0.44 |
| Ex. 14 | 10 | Ni-19.6Cr-1.17Si-0.10Fe-0.01S-0.01C | 98.7 | 19.6 | 0.01 |
| Ex. 15 | 10 | Ni-19.6Cr-1.17Si-0.10Fe-0.01S-0.01C | 98.7 | 19.6 | 0.01 |

*1) Weight ratio based on the total amount of the spray powder.
*2) Weight ratio based on the total amount of the cermet powder.
*3) Weight ratio based on the total amount of the metal powder
*4) The numerals in the identification of alloys represent the contents of the respective metals by weight %. For example, a Ni-20Cr-10Co alloy comprises 20 wt % of Cr and 10 wt % of Co, and 70 wt % of the rest being Ni.

TABLE 2

| | Cermet powder | | | | | | | | |
|---|---|---|---|---|---|---|---|---|---|
| | | WC | CrC | Metal material 1 | | Metal material 2 | | WC powder mean | CrC powder mean |
| | wt % *1) | wt % *2) | wt % *3) | Chemical component | wt % *2) | Chemical component | wt % *2) | particle size (μm) | particle size (μm) |
| Comp. Ex. 1 | 100 | 73 | 20 | Ni | 7 | — | — | 1.5 | 0.8 |
| Comp. Ex. 2 | 100 | 88 | — | Co | 12 | — | — | 1.5 | — |
| Comp. Ex. 3 | 100 | 86 | — | Co-30Cr | 14 | — | — | 1.5 | — |
| Comp. Ex. 4 | 100 | 63 | 18 | Ni | 9 | Ni-20Cr | 10 | 10 | 5 |
| Comp. Ex. 5 | 100 | 70 | 20 | Ni | 10 | — | — | 10 | 5 |
| Comp. Ex. 6 | 100 | 70 | 20 | Ni | 10 | — | — | 10 | 5 |
| Comp. Ex. 7 | 90 | 70 | 20 | Ni | 10 | — | — | 10 | 5 |
| Comp. Ex. 8 | 90 | 70 | 20 | Ni | 10 | — | — | 10 | 5 |

| | Metal powder | | | | |
|---|---|---|---|---|---|
| | wt % *1) | Chemical component *4) | Ni + Cr wt % *3) | Cr wt % *3) | C wt % *3) |
| Comp. Ex. 1 | 0 | | | | |
| Comp. Ex. 2 | 0 | | | | |
| Comp. Ex. 3 | 0 | | | | |
| Comp. Ex. 4 | 0 | | | | |
| Comp. Ex. 5 | 2 | Ni-19.6Cr-1.17Si-0.10Fe-0.01S-0.01C | 98.7 | 19.6 | 0.01 |
| Comp. Ex. 6 | 25 | Ni-19.6Cr-1.17Si-0.10Fe-0.01S-0.01C | 98.7 | 19.6 | 0.01 |
| Comp. Ex. 7 | 10 | Cr-38.2Ni-1.58Si-0.77Mn-0.33Fe-0.08C | 97.2 | 59.0 | 0.08 |
| Comp. Ex. 8 | 10 | Ni-14.6Cr-5.21Si-4.25B-2.55Fe-0.01C-0.03Mn | 88.0 | 14.6 | 0.01 |

Spray Tests and Evaluation of Coatings

Spray tests were carried out by using test samples of Examples 1 to 15 and Comparative Examples 1 to 8. The spray test method and methods for evaluation of sprayed coatings, were as follows.

A. Hardness Measurement

A sprayed coating formed under the following spraying conditions (A) was cut, and its cross-section was mirror-polished, cleaned and dried, whereupon the Vickers hardness of the cross-section of the sprayed coating was measured by Vickers hardness tester HMV-1 (manufactured by Shimadzu Corporation). By averaging the results of tests carried out ten times, the Vickers hardness was obtained and evaluated by the standards as identified in evaluation standards (A).

1) Spraying conditions (A)

Thermal spray equipment: HVOF thermal spray equipment JP-5000,manufactured by TAFA Company Oxygen flow rate: 1,500 scfh Kerosene flow rate: 6.0 gph Substrate: SS400 steel plate (50 mm×70 mm×2.3 mm)

Thickness of sprayed coating: 200 μm

2) Measuring Conditions (A)

Indentater: Diamond pyramid indenter

Angle between the opposite faces: 136°

Load of indentator: 0.2 kgf

Holding time after the loading: 15 seconds

3) Evaluation Standards (A)

◎: Vickers hardness (Hv0.2) of at least 1,100

○: Vickers hardness (Hv0.2) of at least 900 and less than 1,100

X: Vickers hardness (Hv0.2) of less than 900

B. Dry Wear Test

With respect to the sprayed coating formed under the following spraying conditions (B), a dry wear test was carried out by means of a Suga abrasion tester (as disclosed in JIS H8682). The volume ratio of the wear rate ($mm^3$) of the test sample to the wear rate ($mm^3$) of the standard sample was calculated as a wear ratio, and by averaging the results of tests carried out three times, the wear ratio was obtained and evaluated by the standards as identified in evaluation standards (B).

1) Spraying Conditions (B)

Thermal spray equipment: HVOF thermal spray equipment JP-5000,manufactured by TAFA Company Oxygen flow rate: 1,500 scfh Kerosene flow rate: 6.0 gph Substrate: SS400 steel plate (50 mm×70 mm×2.3 mm)

Thickness of sprayed coating: 200 μm

2) Test Conditions (B)

Abrasive paper: SiC#180

Load: 3.15 kgf

Number of abrasion: 400 times

Standard sample: SS400 steel plate (50 mm×70 mm×2.3 mm)

3) Evaluation Standards (B)

⊙: wear ratio (%) of less than 3

○: wear ratio (%) of at least 3 and less than 5

X: wear ratio (%) of at least 5

C. Wet Wear Test

With respect to the sprayed coating formed under the following spraying conditions (C), the wear resistance and corrosion resistance tests of the sprayed coating in a wet environment, were carried out by means of a wet abrader as disclosed in JP-A-2000-180331. The volume ratio of the wear rate ($mm^3$) of the test sample to the wear rate ($mm^3$) of the standard sample, was calculated as a wear ratio, and the wear rate was obtained and evaluated by the standards as identified in evaluation standards (C).

1) Spraying Conditions (C)

Thermal spray equipment: HVOF thermal spray equipment JP-5000,manufactured by TAFA Company Oxygen flow rate: 1,500 scfh Kerosene flow rate: 6.0 gph Substrate: carbon steel tube STKM12C for mechanical structure (ϕ25×H75 mm)

Thickness of sprayed coating: 200 μm

2) Test Conditions (C)

Abrasive: A#8 (JIS R6111)

Concentration of abrasive in slurry: 80 wt %

Test time: 200 hours

Sliding distance: 5.67×105 m

Standard sample: carbon steel tube STKM12C for mechanical structure (ϕ25×H75 mm)

3) Evaluation Standards (C)

⊙: wear ratio (%) of less than 8

○: wear ratio (%) of at least 8 and less than 15

X: wear ratio (%) of at least 15

D. Peel Durability Test

With respect to the sprayed coating formed under the following spraying conditions (D), a peel durability test was carried out by means of a falling ball impact tester shown in FIG. 1. 500 Steel balls (diameter D: 9.5 mm, weight W: 3.32 g) as the number of falling (n) per test, were continuously dropped and collided at a collision angle (θ) of 60° to the sprayed coating of test piece 2 through a guide pipe 1 having an inner diameter (d) of 29.3 mm from a height (L) of 1 m, whereby the surface of the sprayed coating was observed, and the number of durable times until cracking or peeling appeared, was counted. By averaging the results of four tests, the number of durable times was obtained and evaluated by the standards as identified in evaluation standards (D).

1) Spraying Conditions (D)

Thermal spray equipment: HVOF thermal spray equipment JP-5000,manufactured by TAFA Company Oxygen flow rate: 1,500 scfh Kerosene flow rate: 6.0 gph Substrate: S45C steel plate (100 mm×100 mm×5 20 mm)

Thickness of sprayed coating: 100 μm

2) Evaluation Standards (D)

⊙: number of durable times of at least 30

○: number of durable times of at least 20 and less than 30

X: number of durable times of less than 20

The test results of A to D were as shown in Table 3.

From the results shown in Table 3, it is evident that the spray powders and the method for producing the spray powders of the present invention represented by Examples 1 to 15 exhibit extremely high impact resistance, excellent wear resistance as well as excellent corrosion resistance and wear resistance in a wet environment.

TABLE 3

| | Vickers hardness | | Dry wear test | | Wet wear test | | Peel durability test | |
|---|---|---|---|---|---|---|---|---|
| | Measured value | Evaluation | Wear ratio (%) | Evaluation | Wear ratio (%) | Evaluation | Number of durable times (times) | Evaluation |
| Ex. 1 | 951 | ○ | 2.7 | ⊙ | 7.4 | ⊙ | 35.5 | ⊙ |
| Ex. 2 | 991 | ○ | 4.2 | ○ | 7.4 | ⊙ | 23.0 | ○ |
| Ex. 3 | 907 | ○ | 4.6 | ○ | 8.2 | ○ | 34.5 | ⊙ |
| Ex. 4 | 942 | ○ | 2.6 | ⊙ | 8.0 | ○ | 45.0 | ⊙ |
| Ex. 5 | 972 | ○ | 2.7 | ⊙ | 7.2 | ⊙ | 25.5 | ○ |
| Ex. 6 | 994 | ○ | 2.8 | ⊙ | 7.2 | ⊙ | 21.5 | ○ |
| Ex. 7 | 976 | ○ | 2.7 | ⊙ | 9.5 | ○ | 29.8 | ○ |
| Ex. 8 | 1021 | ○ | 2.9 | ⊙ | 7.2 | ⊙ | 29.5 | ○ |
| Ex. 9 | 942 | ○ | 2.9 | ⊙ | 11.8 | ○ | 33.3 | ⊙ |
| Ex. 10 | 968 | ○ | 3.3 | ○ | 7.5 | ⊙ | 24.0 | ○ |
| Ex. 11 | 932 | ○ | 4.4 | ○ | 9.5 | ○ | 36.0 | ⊙ |
| Ex. 12 | 912 | ○ | 3.3 | ○ | 9.8 | ○ | 25.5 | ○ |
| Ex. 13 | 901 | ○ | 3.3 | ○ | 10.2 | ○ | 20.3 | ○ |
| Ex. 14 | 992 | ○ | 3.1 | ○ | 7.5 | ⊙ | 20.3 | ○ |
| Ex. 15 | 812 | x | 4.8 | ○ | 10.3 | ○ | 30.5 | ⊙ |

TABLE 3-continued

| | Vickers hardness | | Dry wear test | | Wet wear test | | Peel durability test | |
|---|---|---|---|---|---|---|---|---|
| | Measured value | Evaluation | Wear ratio (%) | Evaluation | Wear ratio (%) | Evaluation | Number of durable times (times) | Evaluation |
| Comp. Ex. 1 | 1190 | ◎ | 5.4 | x | 7.6 | ◎ | 4.8 | x |
| Comp. Ex. 2 | 1224 | ◎ | 3.1 | ○ | 22.1 | x | 15.5 | x |
| Comp. Ex. 3 | 1198 | ◎ | 3.3 | ○ | 12.3 | ○ | 12.5 | x |
| Comp. Ex. 4 | 1103 | ◎ | 2.9 | ◎ | 8.2 | ○ | 17.8 | x |
| Comp. Ex. 5 | 1053 | ○ | 4.8 | ○ | 7.3 | ◎ | 7.2 | x |
| Comp. Ex. 6 | 823 | x | 7.2 | x | 15.1 | x | 40.5 | ◎ |
| Comp. Ex. 7 | 1011 | ○ | 2.7 | ◎ | 7.4 | ◎ | 17.0 | x |
| Comp. Ex. 8 | 1033 | ○ | 3.4 | ○ | 11.1 | ○ | 12.0 | x |

Further, as compared with Comparative Examples 1 to 8, it is evident that in Examples 1 to 15, the wear resistance in a dry and wet environment is excellent although the Vickers hardness is equal or slightly inferior. It is generally said that that one showing a high Vickers hardness is excellent in wear resistance, but this test results show that the Vickers hardness and the wear resistance are not necessarily interrelated.

The spray powder of the present invention is capable of forming a coating having excellent wear resistance as well as excellent corrosion resistance and wear resistance in a wet environment while maintaining extremely high impact resistance, by thermal spraying to form a coating on a substrate surface. Further, according to the method for producing a spray powder of the present invention, a spray powder capable of forming a sprayed coating having extremely high impact resistance and excellent wear resistance while maintaining excellent corrosion resistance and wear resistance in a wet environment can be produced, as compared with a production method wherein the same components are complexed from the beginning.

Namely, 1) by the spray powder of the present invention which is a spray powder to be used for forming a coating and which comprises from 80 to 97 wt % of a cermet powder and from 3 to 20 wt % of a metal powder, based on the total weight, wherein the metal powder comprises Cr and Ni in a total amount of at least 90 wt %, based on the total weight of the metal powder, and the content of Cr is from 0 to 55 wt %, based on the total weight of the metal powder, it is possible to obtain a sprayed coating excellent in impact resistance, wear resistance and corrosion resistance.

2) By the spray powder of the present invention wherein the above cermet powder contains tungsten carbide, chromium carbide and Ni, it is possible to obtain a sprayed coating having high toughness and impact resistance as well as excellent corrosion resistance in a wet environment.

3) Further, by the spray powder of the present invention wherein the above cermet powder contains tungsten carbide, Co and Cr, it is possible to obtain a sprayed coating having excellent corrosion resistance comparable to a cermet containing tungsten carbide, chromium carbide and Ni.

4) Further, by the spray powder of the present invention wherein the average particle size of the tungsten carbide constituting the above cermet powder is from 2 to 20 μm, a sprayed coating having constantly excellent impact resistance, can be expected.

5) Still further, by the spray powder of the present invention wherein the average particle size of the chromium carbide constituting the above cermet powder is from 1 to 10 μm, it is possible to obtain a sprayed coating having extremely stabilized excellent impact resistance and wear resistance.

6) Further, according to the present invention, by the production method which comprises adding and mixing a cermet powder prepared by an agglomeration-sintering method, a sintering-crushing method or a fusion-crushing method, and a metal powder comprising Cr and Ni in a total amount of at least 90 wt %, based on the total weight of the metal powder, and the content of Cr being from 0 to 55 wt %, based on the total weight of the metal powder, so that their contents would be from 80 to 97 wt % and from 3 to 20 wt %, respectively, based on the total weight of the spray powder, it is possible to present a spray powder capable of forming a coating having extremely high impact resistance, excellent wear resistance as well as excellent corrosion resistance and wear resistance in a wet environment.

The entire disclosure of Japanese Patent Application No. 2001-16585 filed on Jan. 25, 2001 including specification, claims, drawings and summary are incorporated herein by reference in its entirety.

What is claimed is:

1. A spray powder for use in forming a coating, which comprises:

from 80 to 97 wt %, based on the total weight, of a cermet powder and from 3 to 20 wt %, based on the total weight, of a metal powder, wherein the metal powder comprises Cr and Ni in a total amount of at least 90 wt %, based on the total weight of the metal powder, and the content of Cr ranges from 0 to 55 wt %, based on the total weight of the metal powder.

2. The spray powder according to claim 1, wherein the cermet powder contains tungsten carbide, chromium carbide and Ni.

3. The spray powder according to claim 1, wherein the cermet powder contains tungsten carbide, Co and Cr.

4. The spray powder according to claim 1, wherein the mean particle size of tungsten carbide constituting the cermet powder ranges from 2 to 20 μm.

5. The spray powder according to claim 1, wherein the mean particle size of chromium carbide constituting the cermet powder ranges from 1 to 10 μm.

6. The spray powder according to claim 1, wherein the content of C in the metal powder is at most 0.4 wt %, based on the total weight of the metal powder.

7. A method for producing a spray powder for use in forming a coating, which comprises:

adding and mixing a cermet powder prepared by an agglomeration-sintering method, a sintering-crushing method or a fusion-crushing method, and a metal powder comprising Cr and Ni in a total amount of at least 90 wt %, based on the total weight of the metal powder, and the content of Cr ranging from 0 to 55 wt %, based on the total weight of the metal powder, so that their contents range from 80 to 97 wt % and from 3 to 20 wt %, respectively, based on the total weight of the spray powders.

8. The spray powder according to claim 2, wherein the contents of tungsten carbide, chromium carbide and Ni, based on the total weight of the cermet powder, range from 60 to 85 wt %, from 10 to 30 wt % and from 4 to 15 wt %.

9. The spray powder according to claim 8, wherein the contents of tungsten carbide, chromium carbide and Ni, based on the total weight of the cermet powder, range from 65 to 80 wt %, from 15 to 25 wt % and from 5 to 12 wt %.

10. The spray powder according to claim 3, wherein the contents of tungsten carbide, Co and Cr, based on the total weight of the cermet powder, range from 80 to 92 wt %, from 4 to 20 wt % and from 2 to 15 wt %.

11. The spray powder according to claim 10, wherein the contents of tungsten carbide, Co and Cr, based on the total weight of the cermet powder, range from 84 to 90 wt %, from 6 to 12 wt % and from 2 to 10 wt %.

* * * * *